US007971662B2

(12) United States Patent
Beuershausen

(10) Patent No.: US 7,971,662 B2
(45) **Date of Patent: *Jul. 5, 2011**

(54) DRILL BIT WITH ADJUSTABLE STEERING PADS

(75) Inventor: Chad J. Beuershausen, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 39 days.

This patent is subject to a terminal disclaimer.

(21) Appl. No.: 12/237,569

(22) Filed: Sep. 25, 2008

(65) Prior Publication Data

US 2010/0071962 A1 Mar. 25, 2010

(51) Int. Cl.
*E21B 7/08* (2006.01)

(52) U.S. Cl. ..... 175/408; 175/76

(58) Field of Classification Search ..... 175/73, 175/76, 408

See application file for complete search history.

(56) References Cited

U.S. PATENT DOCUMENTS 3,422,672 A * 1/1969 Payne ..... 73/152.53
4,086,698 A 5/1978 Sparks
4,102,415 A * 7/1978 Cunningham ..... 175/96
4,185,704 A 1/1980 Nixon, Jr.
4,262,758 A 4/1981 Evans
4,291,773 A 9/1981 Evans
4,416,339 A 11/1983 Baker et al.
4,471,843 A 9/1984 Jones, Jr. et al.
4,638,873 A 1/1987 Welborn
4,730,681 A 3/1988 Estes
4,842,083 A * 6/1989 Raney ..... 175/325.4
4,856,601 A * 8/1989 Raney ..... 175/393
5,158,109 A 10/1992 Hare, Sr.
5,220,963 A 6/1993 Patton
5,293,945 A 3/1994 Rosenhauch et al.
5,341,886 A 8/1994 Patton
5,419,405 A 5/1995 Patton
5,443,565 A 8/1995 Strange, Jr.
5,467,834 A 11/1995 Hughes et al.
5,553,678 A 9/1996 Barr et al.
5,671,816 A 9/1997 Tibbitts
5,941,321 A 8/1999 Hughes
6,012,536 A 1/2000 Puttmann et al.
6,092,610 A 7/2000 Kosmala et al.
6,138,780 A 10/2000 Beuershausen
6,142,250 A * 11/2000 Griffin et al. ..... 175/381
6,173,797 B1 1/2001 Dykstra et al.
6,209,664 B1 4/2001 Amaudric du Chaffaut
6,253,863 B1 7/2001 Mensa-Wilmot et al.
6,257,356 B1 7/2001 Wassell
6,260,636 B1 7/2001 Cooley et al.

(Continued)

FOREIGN PATENT DOCUMENTS

EP 530045 A1 * 3/1993

(Continued)

*Primary Examiner* — Jennifer H Gay
(74) *Attorney, Agent, or Firm* — Cantor Colburn LLP

(57) ABSTRACT

In an aspect, a drill bit is provided that includes at least one blade profile having a side section and an adjustable pad on the side section that is configured to extend from the side section to cause the drill bit to alter a drilling direction when the drill bit is used to drill a wellbore. In addition, the drill bit may also include a fluid line configured to supply a fluid under pressure to the pad to cause the pad to extend from the side section.

20 Claims, 5 Drawing Sheets

U.S. PATENT DOCUMENTS

| | | | | |
|---|---|---|---|---|
| 6,290,007 | B2 | 9/2001 | Beuershausen et al. | |
| 6,321,862 | B1 | 11/2001 | Beuershausen et al. | |
| 6,349,780 | B1 | 2/2002 | Beuershausen | |
| 6,568,470 | B2 | 5/2003 | Goodson, Jr. et al. | |
| 6,725,947 | B2 | 4/2004 | Palaschenko et al. | |
| 6,840,336 | B2 | 1/2005 | Schaaf et al. | |
| 6,971,459 | B2 * | 12/2005 | Raney | 175/408 |
| 7,090,037 | B2 * | 8/2006 | Best | 175/230 |
| 7,201,237 | B2 | 4/2007 | Raney | |
| 7,287,604 | B2 | 10/2007 | Aronstam et al. | |
| 7,373,995 | B2 | 5/2008 | Hughes et al. | |
| 2002/0011358 | A1 | 1/2002 | Wassell | |
| 2002/0088648 | A1 | 7/2002 | Krueger et al. | |
| 2002/0100617 | A1 * | 8/2002 | Watson et al. | 175/73 |
| 2002/0112887 | A1 | 8/2002 | Harrison | |
| 2004/0238221 | A1 | 12/2004 | Runia et al. | |
| 2005/0024232 | A1 | 2/2005 | Gardner et al. | |
| 2008/0000693 | A1 | 1/2008 | Hutton | |
| 2008/0245570 | A1 * | 10/2008 | Partouche | 175/48 |
| 2009/0044951 | A1 * | 2/2009 | Milkovisch et al. | 166/369 |
| 2009/0044979 | A1 * | 2/2009 | Johnson et al. | 175/24 |
| 2009/0194334 | A1 * | 8/2009 | Johnson et al. | 175/61 |
| 2010/0071956 | A1 * | 3/2010 | Beuershausen | 175/61 |
| 2010/0071962 | A1 * | 3/2010 | Beuershausen | 175/399 |

FOREIGN PATENT DOCUMENTS

| | | | |
|---|---|---|---|
| EP | 1008717 | A1 | 6/2000 |
| GB | 2039567 | A | 8/1980 |
| GB | 2050466 | A | 1/1981 |
| GB | 2352464 | A1 | 1/2001 |
| WO | WO0043628 | A2 | 7/2000 |

* cited by examiner

DRILL BIT WITH ADJUSTABLE STEERING PADS

BACKGROUND INFORMATION

1. Field of the Disclosure

This disclosure relates generally to drill bits and systems for using same for drilling wellbores.

2. Background of the Art

Oil wells (also referred to as wellbores or boreholes) are drilled with a drill string that includes a tubular member having a drilling assembly (also referred to as the drilling assembly or bottomhole assembly or "BHA") which includes a drill bit attached to the bottom end thereof. The drill bit is rotated to disintegrate the rock formation to drill the wellbore. The BHA includes devices and sensors for providing information about a variety of parameters relating to the drilling operations (drilling parameters), the behavior of the BHA (BHA parameters) and the formation surrounding the wellbore being drilled (formation parameters). A large number of wellbores are drilled along a contoured trajectory. For example, a single wellbore may include one or more vertical sections, deviated sections and horizontal sections. Some BHA's include adjustable knuckle joints to form a deviated wellbore. Such steering devices are typically disposed on the BHA, i.e., away from the drill bit. However, it is desirable to have steering devices that are close to or on the drill bit to effect steering, improve rate of penetration of the drill bit and/or to extend the drill bit life.

The disclosure herein provides an improved drill bit, methods for making such a drill bit and apparatus for using such drill bits for drilling wellbores.

SUMMARY

In one aspect, a drill bit is disclosed that in one embodiment may include at least one blade profile having a side section and an adjustable pad on the side section, wherein the adjustable pad is configured to selectively extend from the side section to cause the drill bit to alter a drilling direction when the drill bit is used to drill a wellbore.

In another aspect, a drilling assembly configured to drill a wellbore is disclosed that, in one embodiment, may include: a drill bit attached to an end thereof, wherein the drill bit may further include: one or more blade profiles, each blade profile having a side section; and an adjustable pad on the side section of at least one blade profile; and an actuation device configured to extend the adjustable pad from the side section.

In another aspect, a method for making a drill bit is disclosed that in one embodiment may include: providing at least one blade profile having a side section; and providing an adjustable pad on the side section of the at least one blade profile, wherein the adjustable pad is configured to extend from the side section upon application of a force on the adjustable blade and to retract toward the side section upon the release of the force on the adjustable pad.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DETAILED DESCRIPTION OF THE EMBODIMENTS

Figure 1:
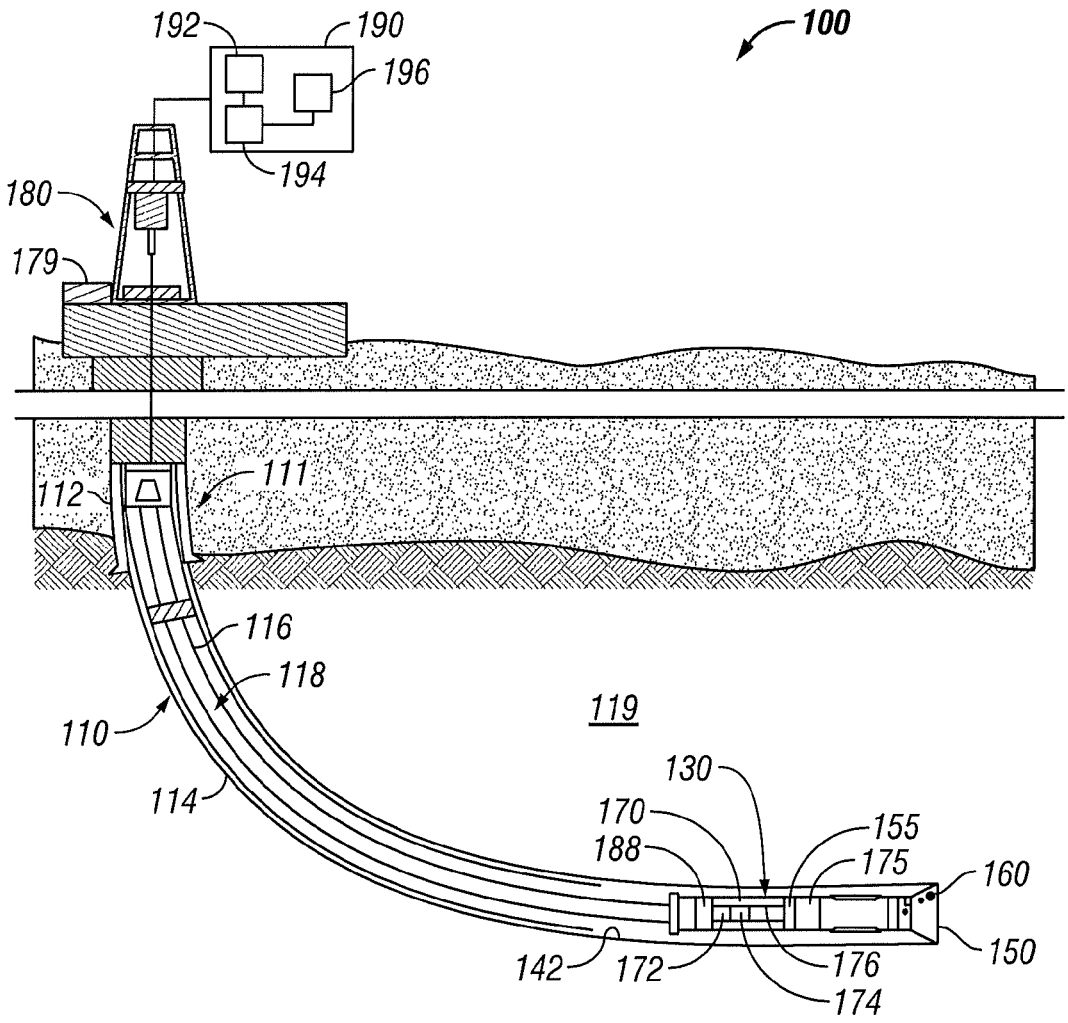
FIG. 1 is a schematic diagram of an exemplary drilling system that includes a drill string that has a drill bit made according to one embodiment of the disclosure at an end of the drill string.

FIG. 1 is a schematic diagram of an exemplary drilling system 100 that may utilize drill bits made according to one embodiment of the disclosure. FIG. 1 shows a wellbore 110 having an upper section 111 with a casing 112 installed therein and a lower section 114 being drilled with a drill string 118. The drill string 118 is shown to include a tubular member 116 with a BHA 130 (also referred to as the "drilling assembly" or "bottomhole assembly" ("BHA") attached at its bottom end. The tubular member 116 may be made up by joining drill pipe sections or it may be a coiled-tubing. A drill bit 150 is shown attached to the bottom end of the BHA 130 for disintegrating the rock formation to drill the wellbore 110 of a selected diameter in the formation 119.

Drill string 118 is shown conveyed into the wellbore 110 from a rig 180 at the surface 167. The exemplary rig 180 shown is a land rig for ease of explanation. The apparatus and methods disclosed herein may also be utilized with an offshore rig used for drilling wellbores under water. A rotary table 169 or a top drive (not shown) coupled to the drill string 118 may be utilized to rotate the drill string 118 to rotate the BHA 130 and the drill bit 150 to drill the wellbore 110. A drilling motor 155 (also referred to as the "mud motor") may be provided in the BHA 130 to rotate the drill bit 150. The drilling motor 155 may be used alone to rotate the drill bit or to superimpose the rotation of the drill string 118. A control unit (or controller) 190, which may be a computer-based unit, may be placed at the surface for receiving and processing data transmitted by the sensors in the drill bit 150 and the BHA 130 and for controlling selected operations of the various devices and sensors in the drilling assembly 130. The surface controller 190, in one embodiment, may include a processor 192, a data storage device (or a computer-readable medium) 194 for storing data and computer programs 196. The data storage device 194 may be any suitable device, including, but not limited to, a read-only memory (ROM), a random-access memory (RAM), a flash memory, a magnetic tape, a hard disk and an optical disk. During drilling, a drilling fluid 179 from a source thereof is pumped under pressure into the tubular member 116. The drilling fluid discharges at the bottom of the drill bit 150 and returns to the surface via the annular space (also referred as the "annulus") between the drill string 118 and the inside wall 142 of the wellbore 110.

Still referring to FIG. 1, the drill bit 150, in one aspect, includes one or more pads (also referred to as the "blades")

160 that may be extended away from or contracted toward the drill bit 150. The pads 160 may be referred to as adjustable pads or blades when their extended position in one or more aspects can be controlled. An actuation device (or unit) 155 in the BHA 130 may be utilized to activate the adjustable pads (also referred to as the adjustable blades) 160 during drilling of the wellbore 110. The BHA 130 may further include one or more downhole sensors, including, but not limited to, sensors generally known as the measurement-while-drilling (MWD) sensors or the logging-while-drilling (LWD) sensors, and sensors that provide information about the behavior of the BHA 130, such as drill bit rotation, vibration, whirl, and stick-slip (collectively designated in FIG. 2 by numeral 175) and at least one control unit (or controller) 170 for controlling the operation of the adjustable pads 160 and for at least partially processing data received from the sensors 175 and the drill bit 150. The controller 170 may include, among other things, a processor 172, such as a microprocessor, a data storage device 174, such as a solid-state-memory, and a program 176 for use by the processor 172 to control the operation of the pads 160, process downhole data and communicate with the controller 190 via a two-way telemetry unit 188. The operation of the pads 160 for steering the drill bit 150 along a desired path and control of other aspects of drilling of the wellbore 110 are described in more detail in reference to FIGS. 2-6.

Figure 2:
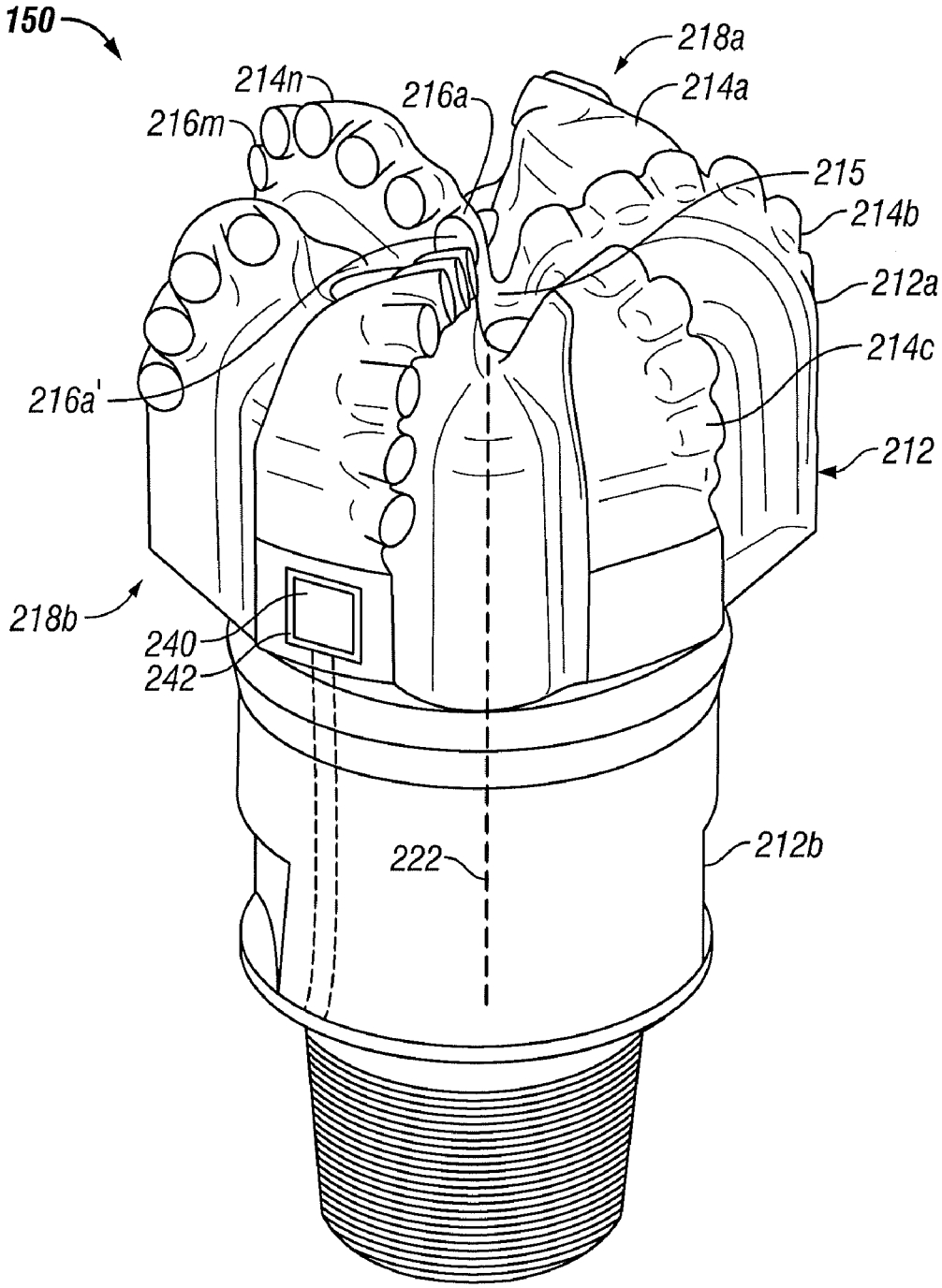
FIG. 2 is an isometric view of an exemplary drill bit showing placement of one or more adjustable pads on the drill bit according to one embodiment of the disclosure.

FIG. 2 shows an isometric view of an exemplary drill bit 150 made according to one embodiment of the disclosure. The drill bit 150 shown is a PDC bit having a bit body 212 that includes a cone 212*a* and a shank 212*b*. The cone 212*a* is shown to include a number of blade profiles 214*a*, 214*b*, . . . 214*n* (also referred to as the "profiles"). Each blade profile has a face or crown section, such as section 218*a* and a side section, such as section 218*b*. A portion of the side section 218*b* is substantially parallel to the longitudinal axis of 222 of the drill bit 150. A number of spaced-apart cutters are placed along each blade profile. For example, blade profile 214*n* is shown to contain cutters 216*a*-216*m*. All blade profiles 214*a*-214*n* are shown to terminate proximate to the bottom 215 of the drill bit 150. Each cutter has a cutting surface or cutting element, such as element 216*a*' of cutter 216*a*, that engages the rock formation when the drill bit 150 is rotated during drilling of the wellbore. Each cutter 216*a*-216*m* has a back rake angle and a side rake angle that defines the depth of cut of the cutter into the rock formation. Each cutter also has a maximum depth of cut into the formation. In one aspect, an adjustable blade, such as blade 240, may be placed in a recess 242 on the side section of one or more blade profiles or at another suitable location on the drill bit 150. The operation of the adjustable pads 240 is described in more detail in reference to FIGS. 3-6.

Figure 3:
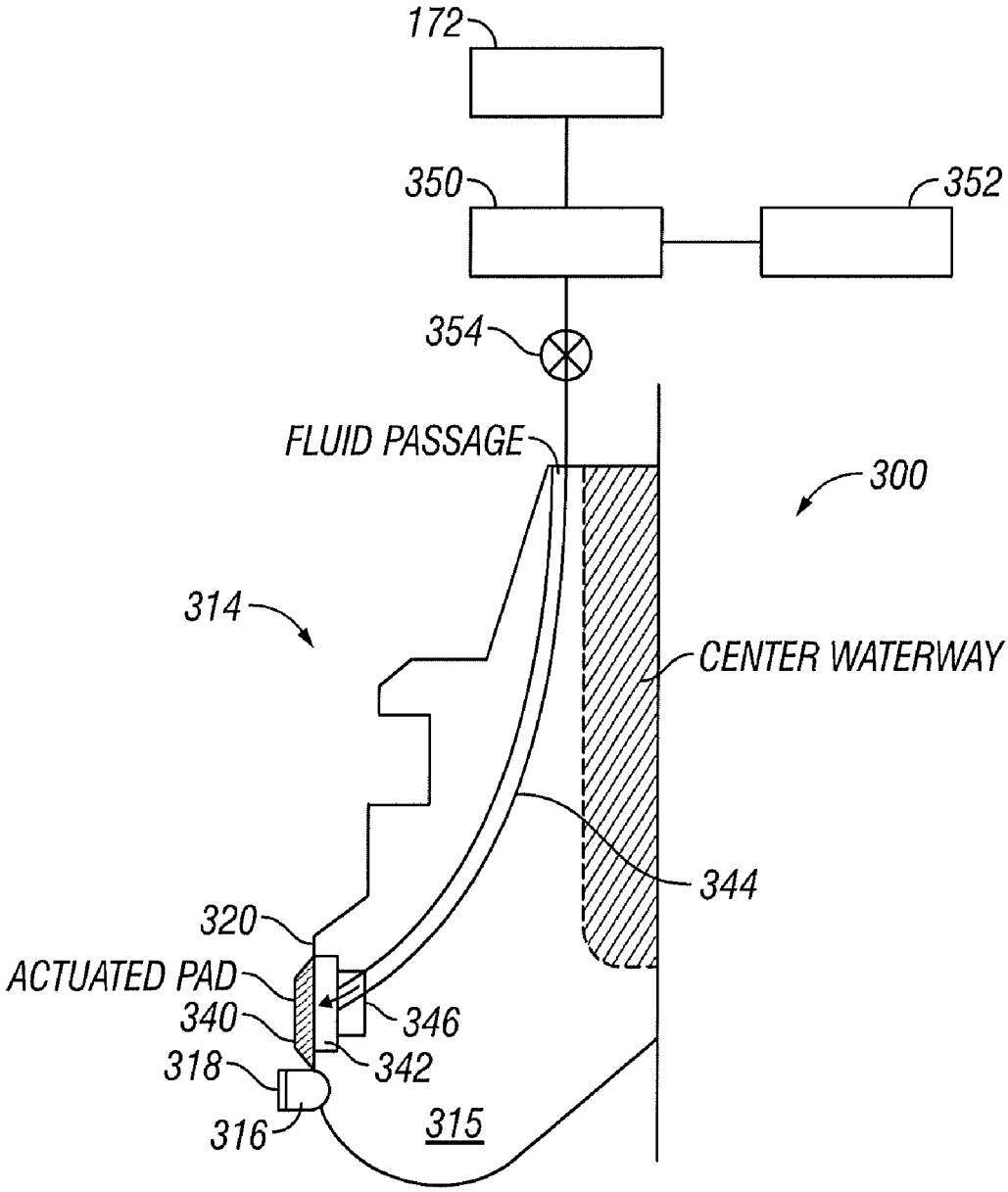
FIG. 3 shows a portion of the drill bit of FIG. 2 that includes a fluid channel in communication with one of the adjustable pads and an actuation device for actuating the adjustable pad according to one embodiment of the disclosure.

FIG. 3 shows a partial side view 300 of an exemplary blade profile 314. The blade profile 314 is shown to include a cutter 316 placed inside the blade body 315. The cutter 316 has a cutting element or cutting surface 318. The cutter 316 extends a selected distance from the side 320 of the blade profile 314. The blade profile 314 also is shown to include an adjustable pad 340 proximate to the cutter 316. The adjustable pad 340 may be placed in a compliant recess or seat 342 in the blade profile body 315. In one embodiment, fluid under pressure from a source thereof may be supplied to the adjustable blade 340 via a fluid line or fluid channel 344 made in the blade profile 315 or at another suitable location in the bit body. The fluid to the pad 340 may be supplied by an actuation or power device 350 located inside or outside the drill bit 150. The fluid may be a clean fluid stored in reservoir 352 or it may be the drilling fluid 178 supplied to the drill bit 150 during drilling of the wellbore. In another aspect, the fluid from the actuation unit 350 may be supplied to a piston 346 that moves the adjustable pad 340 outward (away from the blade profile 315). The actuation device 350 may be any suitable device, including, but not limited to, an electrical device, such as a motor, an electro-mechanical device, such as a pump driven by a motor, a hydraulic device, such as a pump driven by a turbine operated by the fluid flowing in the BHA, and a mechanical device, such as a ring-type device that selectively allows a fluid to flow to the pad 340. The fluid to the pad 340 is held under pressure while the pad is on the low side of the wellbore 110. In one configuration, the pad 340 may be held in a desired extended position by maintaining the actuation device 350 in an active mode. In another aspect, a fluid flow control device 354, such as a valve, may be associated with each adjustable pad to control the supply of the fluid to its associated pad. In such a configuration, a common actuation device 350 may be utilized to supply the fluid to all the control valves. In another configuration, a separate actuation device may be utilized to control the fluid supply to each of the pads. The processor 172 in the BHA (FIG. 1) may be configured to control the operation of the actuation device 350 in response to a downhole-measured parameter or an instruction stored in the storage device 174 or an instruction sent from the surface controller 190. The movement of the adjustable pad 340 relative to fluid supplied thereto may be calibrated at the surface and the calibrated data may be stored in the data storage device 174 for use by the processor 172.

Figure 4:
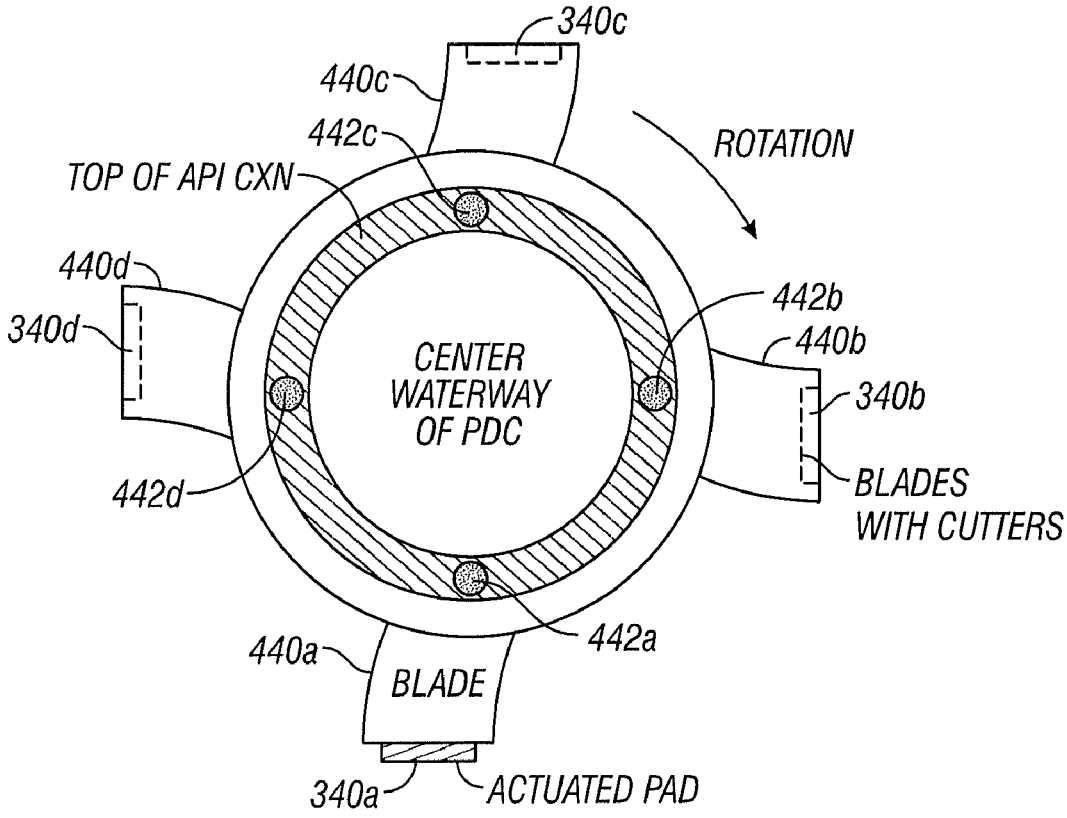
FIG. 4 is a cross-sectional view of the drill bit of FIG. 4 showing a single adjustable pad in an extended position.

FIG. 4 shows a sectional view of the drill bit 150 with four blades 440*a*-440*d*, each having an adjustable pad 340*a*-340*d*. Blade 440*a* is shown to have the pad 340*a* in an extended position. The fluid lines corresponding to the pads 340*a*-340*d* are shown as 442*a*-442*d* respectively.

Figure 5:
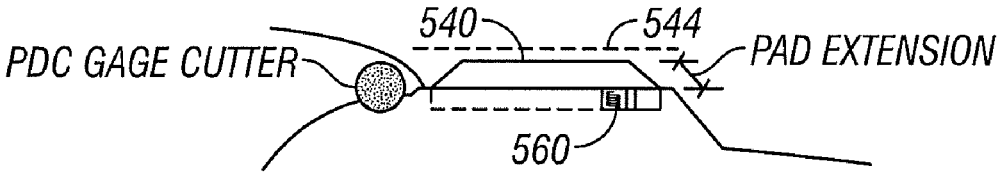
FIG. 5 is a schematic diagram showing the drill bit of FIG. 2 in a wellbore wherein one of the adjustable pads is in an extended position.

FIG. 5 shows an adjustable pad 540 in an extended position. The pad extension may be adjusted by the amount of the fluid supplied thereto. The adjustable pad has a maximum or fully extended position 544 at a distance "d" as shown in FIG. 5. The pad remains at its selected or desired extended position when the valve is closed or by holding the actuation device in manner that prevents the fluid supplied to the pad from returning. When the valve is opened or the actuation device is deactivated, there is no or little force on the adjustable pad. The lack of force enables the pad to retract or retreat from the extend position. A spring 560 also may be provided for each pad to retract the pad 540 when the force on the pad is not applied by the fluid.

Figure 6:
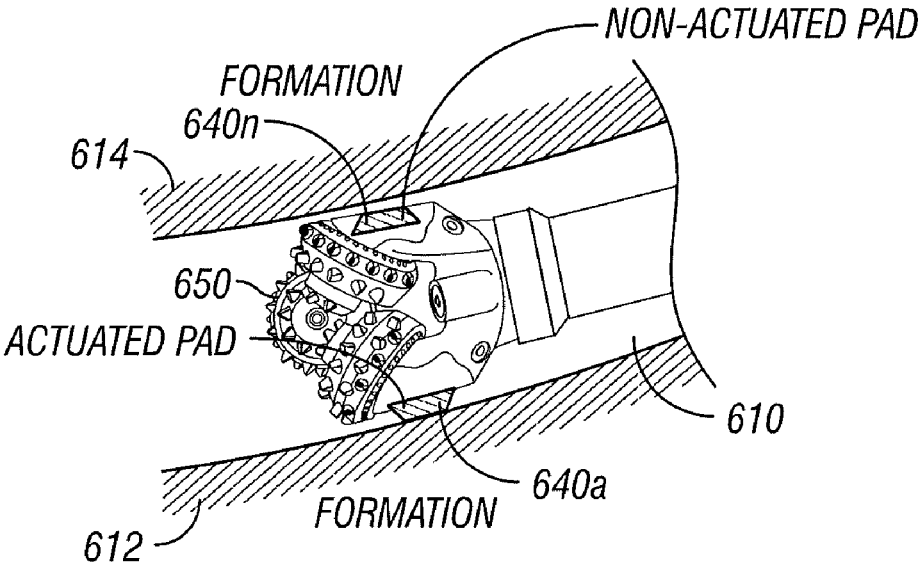
FIG. 6 is a schematic diagram showing one of the adjustable pads in an extended position relative to a cutting element of the drill bit of FIG. 2.

FIG. 6 shows a drill bit 650 having a number of pads thereon in a wellbore 610. During drilling of the wellbore 610, the actuation device activates the pad 640*a* to a selected extended position before the pad 640*a* is to come in contact with the low side 612 of the wellbore 610. The extended pad 640*a* then pushes the drill bit 650 toward the high side 614 of the wellbore 610, thereby pushing the drill bit upward and causing a change in the drilling direction. The pad 640*a* may then be retracted or deactivated. The other pads may be similarly extended and retracted to alter a drilling direction. Although, a number of pads are shown in FIG. 6, a single pad however also may be employed to alter or maintain the drilling direction. The amount of extension of a particular adjustable pad determines the change in the drilling direction, i.e., the steering of the drilling assembly. When more than one pad is mounted on a drill bit, such pads may be sequentially activated and deactivated as they approach and leave the low side 614 of the wellbore 610.

Thus, a drill bit, according to one embodiment, may include at least one blade profile having a face section and a side section and an adjustable pad on the side section that is configured to selectively extend from the side section to cause the drill bit to alter a drilling direction when the drill bit is used on a drill string to drill a wellbore. The drill bit may include a plurality of blade profiles, each such blade profile having a side section having an adjustable pad thereon. The drill bit may further include a fluid line configured to supply a fluid under pressure to the adjustable pad to cause the adjustable pad to extend from the side section. Each blade profile may have a number of cutters thereon and wherein the adjustable pad is configured to extend at least to the depth of cut of the cutters. In one configuration, the adjustable pad may be placed in a cavity made in the side section. In one configuration, a piston may be coupled to the adjustable pad to move or extend the adjustable pad from the side section. The piston may be moved by a hydraulic, electrical or an electro-mechanical device.

In another aspect, a method of making a drill bit is disclosed which may include: providing at least one blade profile having a side section and at least one cutting element thereon; and attaching an adjustable pad on the side section of the at least one blade profile, wherein the adjustable pad is configured to extend from the side section upon application of a force thereon and retract toward the side section upon the release of the force on the adjustable pad.

In another aspect, a drilling assembly is disclosed that has a drill bit at an end thereof, wherein the drill bit includes an adjustable blade on a side of the drill bit that is configured to extend and retract during drilling of a wellbore; and an actuation device configured to selectively apply force onto the adjustable pad to extend the adjustable pad from the drill bit side. A controller associated with the drilling assembly may be configured to control the actuation device. The actuation device may be any suitable device, including, but not limited to, a mechanical device that supplies a drilling fluid to the adjustable pad when it is on a low side of a wellbore, a hydraulic unit that supplies a fluid under pressure to the adjustable pad to extend the adjustable pad from the drill bit side, or an electrical device that is configured to extend the adjustable pad from the drill bit side. A valve in an open position may be utilized to enable the actuation device to selectively supply the fluid to the adjustable pad.

In an aspect, the drilling assembly or apparatus includes a controller to control an operation of the actuation device based on at least one of pressure, tool face and build rate.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

What is claimed is:

1. A drill bit, comprising:

at least one blade profile having a side section;

a pad on the side section of the at least one blade profile, wherein the pad is configured to extend from the side section to cause the drill bit to alter a drilling direction when the drill bit is used to drill a wellbore; and an actuation unit configured to hydraulically actuate the pad, wherein the actuation unit is configured to direct a fluid to actuate the pad from a source outside a central waterway of the drill bit via a separate fluid line in a shank section of the drill bit.

2. The drill bit of claim 1, wherein the at least one blade profile comprises a plurality of blade profiles, each blade profile having a side section that has a pad thereon.

3. The drill bit of claim 1, wherein the separate fluid line comprises a fluid line configured to supply a fluid under pressure to the pad to cause the pad to extend from the side section.

4. The drill bit of claim 1, wherein the at least one blade profile has at least one cutting element having a selected depth of cut and wherein the pad on the side section is configured to extend to at least the depth of the cut.

5. The drill bit of claim 1, wherein the pad is placed in a cavity made in the side section of the at least one blade profile.

6. The drill bit of claim 5 further comprising a piston coupled to the pad to extend the pad from the side section of the at least one blade profile.

7. The drill bit of claim 1 further comprising a biasing member coupled to the pad to retract the pad toward the side section.

8. A method of making a drill bit, comprising:

providing at least one blade profile having a side section and at least one cutting element thereon;

providing an adjustable pad on the side section of the at least one blade profile, wherein the adjustable pad is configured to extend from the side section upon application of a force thereon and retract toward the side section upon release of the force on the adjustable blade; and providing a fluid line in a shank section of the drill bit for supplying a fluid under pressure from a source outside a central waterway of the drill bit to cause the adjustable blade to extend from the side section.

9. The method of claim 8 further comprising providing at least one cutting element on the side section of the at least one blade profile, the at least one cutting element having a depth of cut and wherein the adjustable blade is configured to extend to at least the depth of cut.

10. The method of claim 8 further comprising placing the adjustable blade in a cavity formed in the side section of the at least one blade profile.

11. The method of claim 8 further comprising a piston coupled to the adjustable blade to move the adjustable blade away from the side section of the at least one blade profile.

12. The method of claim 8 further comprising providing a power unit that supplies fluid under pressure to the fluid supply line.

13. The method of claim 8 further comprising coupling a biasing member to the pad to retract the pad toward the side section.

14. An apparatus for use in drilling of a wellbore, comprising:

a drilling assembly that has a drill bit attached to an end thereof, the drill bit comprising:

a plurality of blade profiles, each blade profile having a side section;

an adjustable pad on the side section of at least one blade profile, wherein the adjustable pad is configured extend away from the side section to cause the drill bit to alter a drilling direction when the apparatus is used for drilling the wellbore; and wherein a source located outside a central waterway of the drill bit is configured to direct a fluid to extend the pad via a separate fluid line in a shank section of the drill bit.

15. The apparatus of claim 14 further comprising an actuation device including the source, the actuation device being configured to hydraulically extend the adjustable pad from the side section.

16. The apparatus of claim 15, wherein the actuation device is selected from a group consisting of: a mechanical device that supplies a drilling fluid to the adjustable pad when the adjustable pad is on a low side of the wellbore; a hydraulic unit that supplies a fluid under pressure to the adjustable pad to extend the adjustable blade from the side section; and an electrical device that is configured to extend the adjustable pad from the side section.

17. The apparatus of claim 15 further comprising a controller configured to control the actuation device.

18. The apparatus of claim 17 further comprising a valve that in an open position enables the controller to supply a fluid to the adjustable pad.

19. The apparatus of claim 17, wherein the controller is further configured to control an operation of the actuation device based at least on one downhole property.

20. A drill bit, comprising:

at least one blade profile having a side section;

a pad on the side section of the at least one blade profile, wherein the pad is configured to extend from the side section to cause the drill bit to alter a drilling direction when the drill bit is used to drill a wellbore; and an actuation unit including an actuation device, a flow control device and a reservoir, wherein the actuation unit is configured to direct a clean fluid to actuate the pad via a separate fluid line in a shank section of the drill bit.

* * * * *